United States Patent [19]

Kline et al.

[11] Patent Number: 4,776,295

[45] Date of Patent: Oct. 11, 1988

[54] BOAT FLAPS FOR CONTROLLING AND STEERING A BOAT OPERATING AT LOW SPEEDS

[76] Inventors: Allen J. Kline, Rte. 2, Box 88, Bowman, N. Dak. 58623; Nick J. Lenhardt, Rte. 2, Box 77A, New England, N. Dak. 58647

[21] Appl. No.: 82,375

[22] Filed: Aug. 6, 1987

[51] Int. Cl.[4] ..... B63H 25/44

[52] U.S. Cl. ..... 114/144 R; 16/300; 114/145 R; 114/145 A; 114/285

[58] Field of Search ..... 114/126, 144 R, 145 R, 114/145 A, 285, 286, 287, 152; 16/299, 300, 301

[56] References Cited

U.S. PATENT DOCUMENTS

| | | | |
|---|---|---|---|
| 917,618 | 4/1909 | Lacoste | 114/145 R |
| 1,164,817 | 12/1915 | Hyde | 114/145 R |
| 1,195,149 | 8/1916 | Ollard | 114/145 R |
| 1,863,944 | 6/1932 | Semmes | 114/145 R |
| 2,928,365 | 3/1960 | Moon | 114/145 A |
| 2,998,791 | 9/1961 | Light | 114/126 |
| 3,046,928 | 7/1962 | Sherrill | 114/286 |
| 3,159,134 | 12/1964 | Winnen | 114/145 R |
| 3,565,030 | 1/1969 | Curtis | 114/285 |
| 3,581,693 | 6/1971 | Ilon | 114/126 |
| 3,763,812 | 10/1973 | Rowe | 114/145 A |
| 3,982,493 | 9/1976 | Cronin | 114/126 |
| 4,004,536 | 1/1977 | Bernier | 114/144 R |
| 4,573,930 | 3/1986 | Queen | 440/63 |
| 4,577,580 | 3/1986 | Diffley, Sr. | 114/285 |
| 4,583,262 | 4/1986 | Werner | 16/300 |

*Primary Examiner*—Sherman D. Basinger
*Assistant Examiner*—Thomas J. Brahan
*Attorney, Agent, or Firm*—Orrin M. Haugen; Thomas J. Nikolai; Frederick W. Niebuhr

[57] ABSTRACT

The present invention is directed to spring biased trolling flaps used in conjunction with a motorized fishing boat for limiting the speed of the boat while trolling and coupled to the steering mechanism of the boat to aid in steering the boat when the boat is operating at a slow speed.

9 Claims, 2 Drawing Sheets

BOAT FLAPS FOR CONTROLLING AND STEERING A BOAT OPERATING AT LOW SPEEDS

BACKGROUND OF THE INVENTION

While sport fishing, certain species are best caught while trolling at a very slow speed. In the prior art, many types of motors exist for moving fishing boats at varying speeds. However, fishermen using such motors on their boats have encountered two significant problems in attempting to troll. First, many of the motors tend to move the boats too quickly through the water. Second, when the boat is moving at a desired slow speed, it is often very difficult to steer.

U.S. Pat. No. 4,577,580 issued on Mar. 25, 1986 to Diffely, Sr. attempts to address the first of the problems listed above. This patent describes the need for a trolling attachment to reduce the speed of the boat even when the boat is idling. This patent discloses an arrangement which incorporates a pair of flaps attached to the rear of the boat which can be raised and lowered in unison by a handle attached to the flaps. When in their lowered position, these flaps are below the lowermost portion of the boat, penetrating the water and acting as a brake.

Similarly, U. S. Pat. No. 3,763,812 which issued on Oct. 9, 1973 to Rowe discloses the use of vertically slidable trolling boards which can be raised or lowered manually. When in their lowered position the trolling boards extend below the lowermost portion of the boat and into the water to act as a brake. The apparatus shown in the Diffely, Sr. and Rowe Patents both suffer from the problem that they must be manually manipulated and do not automatically become non-functional when the boat is intentionally driven at above idle speeds. Further, the devices disclosed in these two patents do not aid steering of the boat.

U. S. Pat. No. 3,046,928 which issued on July 31, 1962 to Sherrill also discloses a pair of flaps located on the back of the boat. However, the Sherrill Patent is concerned with trim tabs for the boat and these tabs are not intended to be used as a trolling brake. Instead, they are used such that when the boat is moving at an appreciatable speed, they balance the boat so that the boat does not list in one direction or the other because of the weight distribution of passengers in the boat. The trim tabs of Sherrill are raised and lowered hydraulically. Further, they are not associated with the steering feature of the boat and, therefore, are not involved in determining the turning radius of the boat.

U.S. Pat. No. 2,928,365 which issued on Mar. 15, 1960 to V. W. Moon is directed to a pair of flaps which are intended to act as a brake or drag on the boat. While the apparatus of the Moon Patent is spring loaded so that the apparatus will not hamper the operation of the boat in either the forward cruising operation or the reverse operation, it is, again, not in any way attached to the steering mechanism of the boat. It, therefore, does not aid in controlling the responsiveness of steering of the boat. Further, since the two flaps of the Moon design are integral with one another, it is impossible for one to be raised while the other is lowered or vice-versa.

In view of the foregoing, there is a real need in the art for automatic trolling flaps which not only control the speed of the boat when trolling, but also aid in controlling the attitude and steering of the boat. Further, there is a need for an apparatus which will not interfere with proper operation of the boat when it is desired to drive it at higher cruising speeds. The present invention provides an apparatus which performs these functions.

SUMMARY OF THE INVENTION

In its simplest form, the present invention is comprised of a pair of flat plates typically twelve inches wide and sixteen inches long, which are mounted on the transom of a boat using spring loaded hinges. The springs normally bias the plates to a vertical downward position relative to the bottom of the boat wherein the plates tend to act as brakes for the boat until such time as the operator wishes to travel at higher speeds. As the operator causes the boat to accelerate, the forward movement of the boat and drag of the water against the plates creates enough force against them to overcome the counter-force of the springs to cause the plates to rise to a generally horizontal disposition behind the transom. The respective plates are mounted on the transom on opposite sides of the motor's lower unit and are coupled by suitable cables to the motor so that when the boat is being operated at a trolling speed and the tiller of the motor is turned for steering, one plate will be elevated while the other remains down. This significantly improves the maneuverability of the boat at low speeds even in wind and current conditions.

Thus, it is a principal object of the present invention to provide an apparatus which will help fisherman control the speed of their boat while trolling.

Another important object of the present invention is to provide an apparatus which will not only help fishermen maintain a desired low trolling speed of their boat while fishing, but which also enhance the maneuverability of the boat when it is being operated at slow trolling speeds.

Still another object of this invention is to provide an apparatus which improves the relative stability of the boat in choppy water and during high speed turns.

Yet another object of this invention is to provide an apparatus which not only brakes the craft at low motor speeds but also assists in maintaining the craft on-plane at higher speeds.

Still another object of the invention is to provide speed retarding flaps for a motor-driven water craft whereby a desired low boat speed can be maintained with higher engine rpm, thus, to operate more efficiently than otherwise possible.

These, together with other objects and advantages of the invention will become subsequently apparent, when the details of construction and operation are more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
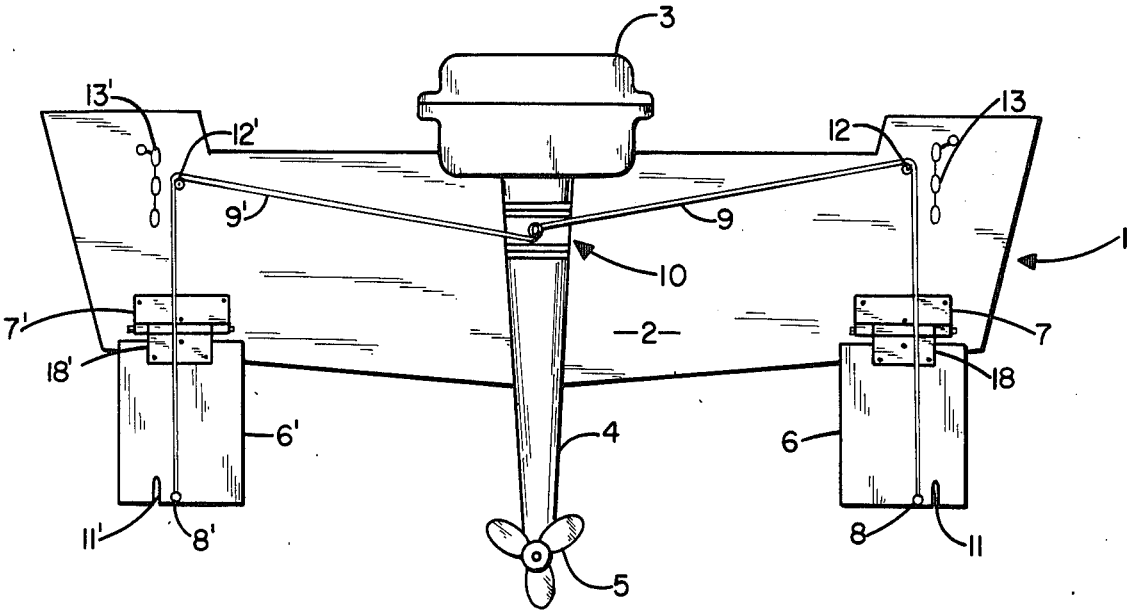
FIG. 1 is a rear view of a fishing boat equipped with the boat flaps for controlling the speed and maneuverability of the boat while trolling.

Referring initially to FIG. 1, there is illustrated a conventional form of the stern of a motorboat 1 showing the transom 2 fitted with an outboard motor 3 having a lower unit 4 and a propeller 5. As those skilled in the art will immediately recognize, outboard motors, such as the motor 3, generally are secured to the transom of a boat and pivot about a vertical axis. The motor includes a throttle for controlling the speed of the propeller 5 and a steering mechanism for pivoting the motor to control the direction of movement of the boat. While the invention is illustrated as being used with a conventional outboard motor, the principles can also be applied to boats powered by inboard or inboard/outboard motors.

Figure 2:
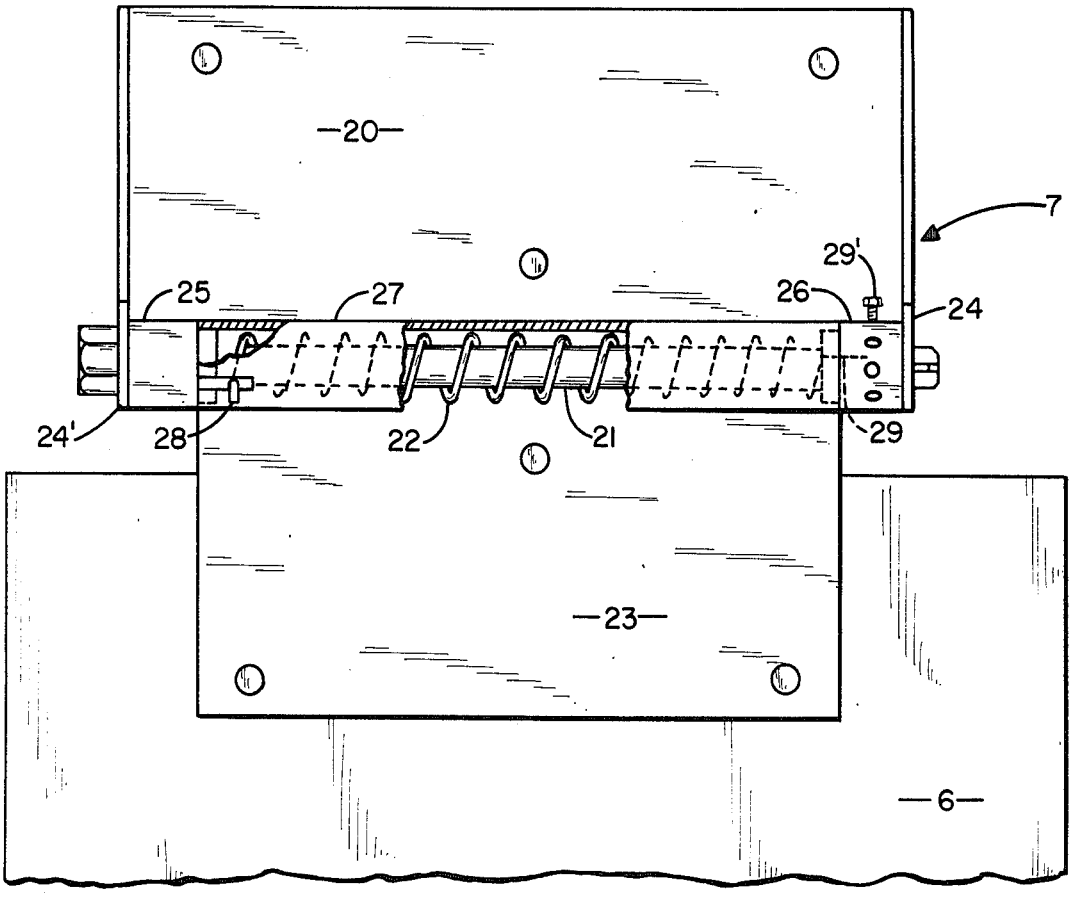
FIG. 2 is intended to show the details of construction of the boat flaps of the present invention.

The present invention includes a pair of flaps 6 and 6' which are hingedly attached to the lower edge of the boat's transom 2 at opposite sides thereof by hinge members 7 and 7' respectively. The details of construction of hinge 7 are shown more particularly in FIG. 2 and are seen to include a mounting plate 20 which is intended to be fastened to the transom of the boat, a horizontal shaft 21, a torsion spring 22 surrounding the shaft 21 and a lower plate 23 to which the flap member 6 is fastened. As shown in FIG. 2, the plate 20 has outwardly projecting tabs 24 and 24' integrally formed therewith through which the shaft 21 passes. The shaft 21 also passes through bearing collars 25 and 26 positioned at opposite ends of spring 22 and are spaced apart by the rounded edge portion 27 of plate 23 which is formed into a tube surrounding shaft 21 and spring 22. One end 28 of spring 22 is fastened to the tube portion 27 of plate 23 and the other end 29 of the spring is effectively joined to the shaft 21 via the end bearing 26 which is keyed to the shaft by a set screw 29' as shown. The tension of the spring 22 can be adjusted by rotating shaft 21 using a wrench on the bolt head on the left end of the shaft to a desired torque setting, then replacing the locking pins. Thus, the hinge mechanism also includes means by which one end of the spring is operatively secured to member 23 of the hinge and the other end of the spring is operatively coupled to member 20 of the hinge so that the hinge will be biased by a desired torque to maintain the flap 6 in its downward position until such time as the boat has obtained sufficient speed so that the pressure of water against the flap forces it up into a position substantially parallel with the bottom of the boat's hull. The adjustable torque feature permits the invention to be used with a range of boat and motor sizes.

FIG. 1 also discloses that the apparatus of the present invention includes a cable 9 which is secured at one end to the lowermost portion of the flap 6 by suitable attachment means 8. Cable 9 is then fed over a pulley 12 and is attached to a steering bracket 10 mounted on the lower unit 4. Similarly, associated with flap 6' is a cable 9' running over pulley 12' between the steering harness 10 and the lowermost portion of flap 5'. One end of the cable 9' is attached to flap 6' by means of the attachment 8'. Further, because it may be desirable to retain either or both of the flaps in a position to render them non-functional, a slot 11 has been cut into flap 6 and a similar slot 11' has been cut into flap 6'. These notches 11 and 11' are intended to receive a link of the associated chain 13 or 13' to retain the flaps in a non-functional position.

From the above description, those skilled in the art will recognize that if the motor is pivoted to turn the boat to the right, cable 9' will cause flap 6' to be lifted while flap 6 remains down to aid in turning. Similarly, if the motor is pivoted to cause turning of the boat to the left the cable 9 will cause the flap 6 to be raised. By raising one of the flaps in this manner while the other flap remains in the down position, turning of the boat is aided substantially, particularly when the boat is being operated at very slow speeds.

Figure 3:
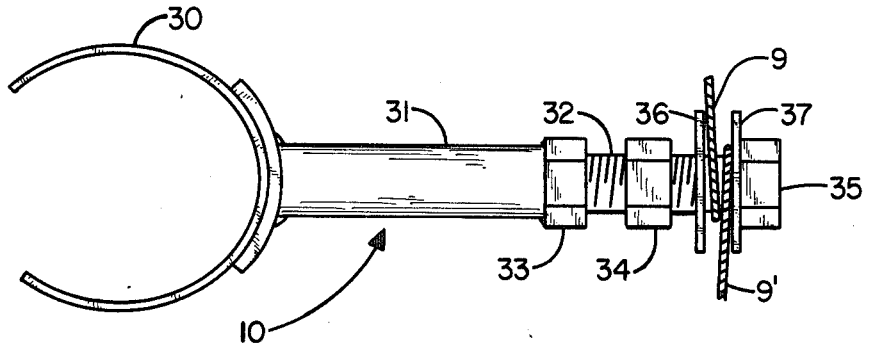
FIG. 3 is intended to show the harness used to couple the boat flaps to the steering mechanism of the boat.

FIG. 3 describes the harness 10 which is used to couple the cables 9 and 9' to the lower unit 4 of the motor 3 to achieve the above-described steering function of the flaps. As shown in FIG. 3, the harness 10 is comprised of an arcuate plate 30 designed to fit around a substantial portion of the lower unit. Coupled to the plate 30 by means of a weldment is an arm 31 which has a threaded end 32. Associated with the threaded end 32 of arm 31 are nuts 33, 34 and 35 and washers 36 and 37. Nut 33 is intended to act as an adjustment for retaining the proper spacing between the lower unit of the motor and the location where the cables 9 and 9' are fastened to the arm 31 as shown in FIG. 3. Nut 34 and washer 36 are positioned on one side of the location where cables 9 and 9' are looped over the threaded portion 32. Similarly, washer 37 and nut 35 are turned on to threaded portion 32 of arm 31. The nuts 34 and 35 are then tightened to pinch washers 36 and 37 as well as the looped portion of cables 9 and 9' together.

Figure 4:
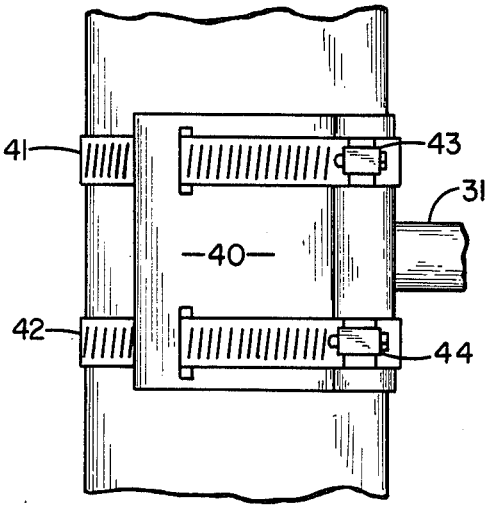
FIG. 4 is intended to show the means by which the harness of FIG. 3 is secured to the lower unit of the boat motor.

FIG. 4 is a side view of the means used to couple the collar 30 of the arm to the lower unit 4 of the motor. These means include a pad 40 which rests over the collar 30 and a pair of adjustable hose type clamps 41 and 42 which surround the lower unit in the area over the pad 40 and the collar 30. The hose clamps 41 and 42 can then be tightened in place by the respective screw mechanisms 43 and 44 of the clamps.

It can be seen that the present invention affords a number of advantages to the boat operator when either trolling or moving at substantially higher speeds.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. For use in conjunction with a fishing boat having a motor including a steerable tiller generally located at the transom of the boat, and apparatus comprising:

(a) first and second flap members pivotally attachable to said transom of the boat on opposite sides of said steerable tiller, said flaps being movable between a first position wherein they extend downwardly from the bottom of said boat and a second position wherein said flaps extend generally rearwardly;

(b) spring means for biasing said flaps toward said first position;

(c) a cable member secured to each of said first and second flaps; and (d) connecting means for operatively securing said cable members to said tiller so that when said tiller is steered in one direction, only said first flap member will be raised to its second position and when said tiller is steered in the opposite direction, only the second flap member will be raised to its second position, said connecting means including a harness comprised of a removable arcuate plate conforming to the contour of and fastened to said tiller, an arm projecting from said arcuate plate, said arm having an end portion which is threaded, adjustable means associated with the threaded portion of said arm for retaining the desired spacing between the tiller and said cable members, and fastening means associated with said threaded portion for securing said cable members to said arm.

2. The apparatus of claim 1 wherein said spring means cause said flaps to remain in said first position until the water pressure acting on said flaps or tension on a cable member causes said flap to raise to said second position.

3. The apparatus of claim 1 further including locking means for securing said first and second flap members in said second position.

4. The apparatus of claim 3 wherein said locking means include a chain secured to said boat near said hinge means and a slot in the outermost end of each of said flaps, said slot being wider than a link of said chain but narrower than the joint between said links.

5. The apparatus of claim 1 wherein said arcuate plate is fastened to said tiller by a plurality of adjustable clamps surrounding said plate and tiller to secure said arcuate plate to said tiller.

6. The apparatus of claim 5 wherein said fastening means for securing said cable members to said arm includes a plurality of nuts threaded onto said threaded end of said arm.

7. Trolling flaps for attachment to the transom of a motor driven boat comprising:

(a) first and second mounting plates attached to said transom at locations generally equally spaced away from said motor on opposed sides thereof;

(b) first and second generally flat flap members hinged to said mounting plates for movement between a position perpendicular to the surface of said transom to one parallel to the surface of said transom;

(c) first and second spring means operatively coupled between said flap members and said mounting plates for normally urging said flap members to said parallel position with a predetermined force; and (d) means coupling a steerable member of said boat to said first and second flap members operative to move the particularly one of said flap members on the side of said boat opposite the direction of turning to said perpendicular position, said coupling means including first and second cables attached at first ends thereof to said first and second flap members, a removable arcuate plate conforming to the contour of and fastened to the steerable member of said boat, an arm projecting from said arcuate plate, said arm having an end portion which is threaded, adjustable means associated with the threaded portion of said arm for retaining the desired spacing between said steerable member and the second ends of said cables, and fastening means associated with said threaded portion for securing the second ends of said first and second cables to said arm.

8. The trolling flaps as in claim 7 wherein said first and second spring means each comprises:

(a) a torsion type coil spring having a first end thereof secured to said flap;

(b a shaft extending through the center of said coil spring and having a collar affixed to said shaft, the second end of said spring being secured to said collar such that when said shaft is rotated in one direction, the spring tension is increased; and (c) means for locking said collar to said mounting plate to prevent rotation of said collar except when said shaft is being rotated.

9. The trolling flaps as in claim 8 wherein said flap members include an integrally formed tube along one edge thereof for receiving said coil spring and shaft therein.

* * * * *

UNITED STATES PATENT AND TRADEMARK OFFICE

CERTIFICATE OF CORRECTION

PATENT NO. : 4,776,295

DATED : October 11, 1988

INVENTOR(S) : Allen J. Kline and Nick J. Lenhardt

It is certified that error appears in the above-identified patent and that said Letters Patent is hereby corrected as shown below:

Claim 7(d), column 6, line 10, change "particularly" to -- particular --.

Signed and Sealed this

Twenty-eighth Day of February, 1989

*Attest:*

DONALD J. QUIGG

*Attesting Officer*

*Commissioner of Patents and Trademarks*